US008100786B2

(12) United States Patent
Hartmann

(10) Patent No.: US 8,100,786 B2
(45) Date of Patent: Jan. 24, 2012

(54) TENNIS-GAME SCOREKEEPING SYSTEM AND METHOD

(76) Inventor: Lynne A. Hartmann, Melbourne Beach, FL (US)

( * ) Notice: Subject to any disclaimer, the term of this patent is extended or adjusted under 35 U.S.C. 154(b) by 106 days.

(21) Appl. No.: 12/543,506

(22) Filed: Aug. 19, 2009

(65) Prior Publication Data

US 2010/0069180 A1 Mar. 18, 2010

Related U.S. Application Data

(60) Provisional application No. 61/097,926, filed on Sep. 18, 2008.

(51) Int. Cl.
*A63B 49/00* (2006.01)

(52) U.S. Cl. ..... 473/553

(58) Field of Classification Search ..... 473/524, 473/553; 273/DIG. 26
See application file for complete search history.

(56) References Cited

U.S. PATENT DOCUMENTS

| | | | | |
|---|---|---|---|---|
| 434,425 | A | 8/1890 | Cooper | |
| 3,986,715 | A | 10/1976 | Glick | |
| 4,021,039 | A | 5/1977 | Hay | |
| 4,158,342 | A | 6/1979 | Scruggs | |
| 4,164,910 | A | 8/1979 | Feiler | |
| 4,172,595 | A | 10/1979 | Sewell | |
| 4,185,583 | A | 1/1980 | Stamm | |
| 4,202,544 | A | 5/1980 | Popma | |
| 4,331,098 | A | 5/1982 | Rubano | |
| 4,357,895 | A | 11/1982 | Nightingale | |
| 4,498,668 | A | 2/1985 | Bowen | |
| 4,738,449 | A | 4/1988 | Droz | |
| 5,489,122 | A | 2/1996 | Pittner | |
| 5,879,249 | A | 3/1999 | Fox-Gurcay | |
| 6,012,995 | A | 1/2000 | Martin | |
| 6,210,296 | B1 * | 4/2001 | Gabriel | 473/553 |
| 6,234,918 | B1 * | 5/2001 | Nally et al. | 473/473 |
| 7,300,366 | B1 * | 11/2007 | Hickey | 473/522 |
| 7,427,245 | B2 * | 9/2008 | Hickey | 473/553 |
| 7,517,293 | B1 * | 4/2009 | Smith | 473/522 |
| 2002/0072438 | A1 * | 6/2002 | Boxer | 473/553 |
| 2004/0016391 | A1 | 1/2004 | Gordon | |
| 2010/0069180 | A1 * | 3/2010 | Hartmann | 473/553 |

FOREIGN PATENT DOCUMENTS

| | | |
|---|---|---|
| DE | 202005016705 U1 | 2/2006 |
| JP | 2005058715 | 3/2005 |

* cited by examiner

*Primary Examiner* — Raleigh W. Chiu
(74) *Attorney, Agent, or Firm* — Frank M. Washko

(57) ABSTRACT

A system of 8 loops (300) of elastic material and a method for keeping score or determining the winner of a tie-break during a tennis game using the 8 loops is disclosed. Of the 8 loops, 4 are to be affixed to a left shaft and 4 are to be affixed to a right shaft of an assembly with at least two shafts. The loops (300) of elastic material are affixed under light tension so that they can be moved easily by the player or spectator and then stay in place once positioned. The loops (300) are marked contrastingly so that they can be easily distinguished for keeping score as necessary. Each point is marked by positioning one of the eight loops in an upwards or downwards direction, an improvement over prior-art which called for a single marker being placed over a specific figure. Several embodiments of the present invention are described.

12 Claims, 6 Drawing Sheets

TENNIS-GAME SCOREKEEPING SYSTEM AND METHOD

CROSS-REFERENCE TO RELATED APPLICATIONS

This application claims priority benefit of U.S. Provisional Patent Application No. 61/097,926, entitled "Tennis-Game Scorekeeping System and Method," filed Sep. 18, 2008. The disclosure in that application is incorporated herein in its entirety.

BACKGROUND

The present invention relates generally to sporting game scoring systems, and more specifically, to a system that allows a player or spectator to keep score during each game and tie break of a tennis match.

Tennis players are familiar with arguments between tennis players over the correct score during a game of tennis. Intense heat, intense focus on playing well, long rallies, the player serving neglecting to call out the score before serving, long injury breaks, and distracting arguments over line calls are some of the reasons players forget the score of the game.

Devices may already exist wherein an apparatus is affixed to a tennis racket for keeping score during a tennis-game. One possible marking device, like a lever or switch or dial, may be graduated to the correct, printed number. The numbers on these existing devices may use typical scoring for tennis: 0, 15, 30, etc. Thus, these devices require the player to locate a written number or word on the racquet utilizing fine motor skills. These devices, which rely on a dial, switch, sliding bar or other single marker to be moved a tiny amount of space onto a correct number or word, and not the incorrect number or word next to it, are difficult to use. Users sometimes have to concentrate on moving a scoring marker to the specific position marked with the typical tennis score, representing a numeric score.

These systems assume that tennis players participating in a gross motor skill sport would enjoy switching, between points, to the fine motor skill of manipulating small devices while searching for the correct small number, and, before marking the point, translating the point won into the typical tennis score, such as 0, 15, 30, etc., which can be numeric or a word score. However, in actual tennis matches when players are arguing about the correct score, they will invariably say, "I won the first point" and not, "I won the '15' point."

Numerous disadvantages are inherent in such systems. For example, such systems may call on the player to switch from gross motor skills and gross vision tasks, the playing of the tennis point, to fine motor skills and fine vision skills. Second, a player may need to move a marker into the correct position and read small numbers to mark the point. Also, each position abutting the next, there is the possibility of making a mistake (marking, say, 30 instead of 40). It may also require the user to a read small number and hold the racquet at a close and inconvenient location to do so. In some cases, a small number can only be read if the racquet is held in one particular position.

When resetting the prior-art device after a game has been won, the player has to look to see if he has returned the marking device to the number '0' or the word 'love'. Since a player's intense mental focus on gross motor skills during play of a tennis match might become slightly compromised by engaging in performing such fine motor skills and fine vision skills unnecessary to the game, he would probably avoid using such a scoring device. Finally, many past systems involved gluing a device onto the racket which, when removed or when it fell off, left a sticky residue, or other change to the racquet.

In accordance with one possible embodiment, a tennis-game score-keeping system and method consisting of a number of separate loops of elastic material which are affixed under light tension to the throat of a tennis racket. More than one loop are attached to the left side of the throat of the tennis racket and are positioned to represent the player's score and more than one loop are affixed to the right side of the throat of a tennis racket and are positioned to represent the opponent's score.

In another embodiment, an 8 loop score-keeping system and method is attached to an assembly with at least 2 elongated shafts, with 4 of the loops attached to a left shaft and 4 of the loops attached to a right shaft. In yet another exemplary embodiment of the present invention, no use may be made of the typical numeric tennis scores, such as 0, 15, 30, in the device itself. Instead, a binary scoring system may be used in one possible embodiment of the scoring system. Other advantages, features, and embodiments are described below.

DRAWINGS

Reference Numerals

FIG. 1

100—modern tennis racket
112—head of the racket
114—throat of the racket, or shafts
**114*a***—the left side of the throat of the racket, or left shaft
**114*b***—the right side of the throat of the racket, or right shaft
116—bottom of the throat-of the racket
118—grip of the racket
300—the scoring system, the 8 elastic loops
310—first loop, on left side of throat **114*a***
320—second loop, on left side of throat **114*a***
330—third loop, on left side of throat **114*a***
350—first loop, on right side of throat **114*b***
360—second loop, on right side of throat **114*b***
370—third loop, on right side of throat **114*b***
390—fourth loop on left side of throat **114*a***
395—fourth loop on right side of throat **114*b***

Detail A

400—typical square knot for each loop of the first embodiment
500—typical crimp for each loop of the first embodiment FIG. 2, FIG. 3, FIG. 4, FIG. 5, FIG. 6—As above.

Glossary of technical tennis terms:

This glossary is meant for the purpose of clarifying the possible embodiments in this disclosure and is meant to be non-limiting. Other terms or other tennis scoring schemes are also possible and are incorporated into the present invention.

0 or love: no point has been made in a game within a tennis match.

15: the first point won by a player in a particular game.

30: the second point won by a player.

40: the third point won by a player.

Deuce: when players are tied at 40 (three points each), the score is called "deuce." At deuce, a player must win two points in a row to win the game. If the players split the following two points, the score reverts to deuce.

Ad-in: indicates that the server has the advantage; also "advantage"

Ad-out: indicates that the receiver has the advantage; also "advantage out"

Note: When reading the score, the score of the player who is serving is recited first.

DETAILED DESCRIPTION

While the exemplary embodiments illustrated herein may show the various features, it will be understood that the features disclosed herein can be combined variously to achieve the objectives of the present invention.

Figure 1:
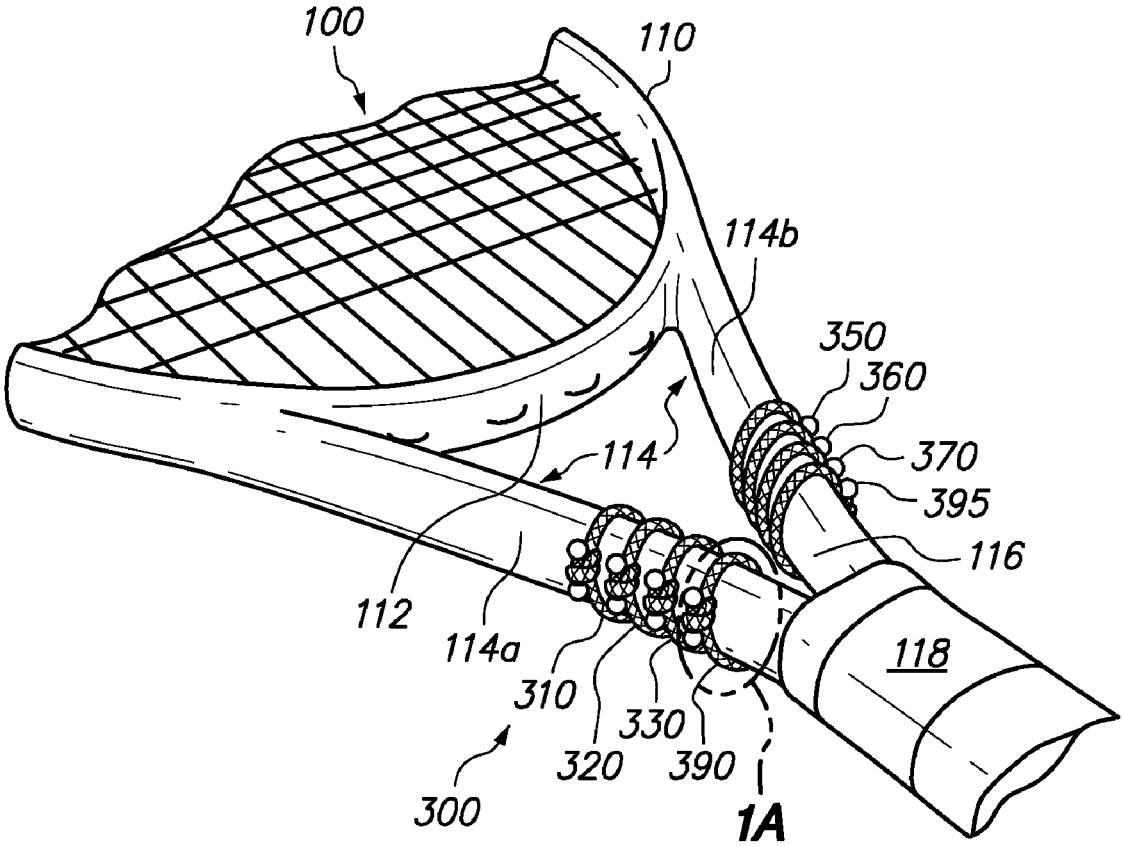
FIG. 1 shows a diagram of one embodiment of the scoring system showing a modern tennis racket with 8 elastic loops, affixed to the throat, or shafts, of the racket. Detail A of FIG. 1 shows a detail of the square knot and crimps from FIG. 1.
Figure 1A:
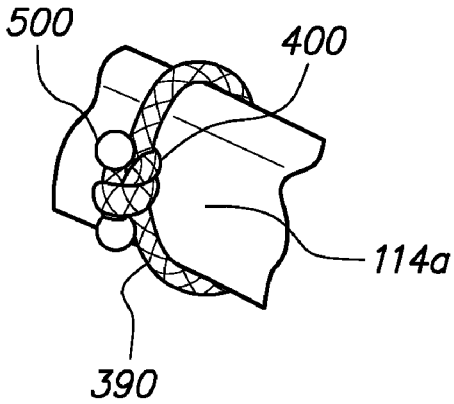

FIG. 1 shows one possible preferred embodiment, with a scoring system of eight loops 300, attached to the throat 114 of a tennis racket 100. A typical modern tennis racket 100 has a frame 110 comprising a head 112, a throat or shafts_114, a bottom of throat 116 and a grip 118. The throat 114 has two elongated branches or two shafts 114*a* and 114*b*, also called the left side of the throat or called the left shaft 114*a* and the right side of the throat or right shaft 114*b*.

The tennis racket 100 includes a grip 118 having a first end and ending in a bottom of throat 116, the bottom of throat 116 is coupled to a throat 114, the throat 114 consisting of a pair of elongated shafts 114*a* and 114*b*, each pair of elongated shafts extending between a respective side of the bottom of throat 116 and the head 112. An embodiment of the present invention is shown in FIG. 1 affixed to the throat 114 of the racket.

In this embodiment, each loop 300 is affixed to the throat 114. The loop 300 may be composed of a variety of materials, including: elastic cord, fabric, non-elastic string, rubber, polymer, neoprene, or any other suitable material. In this embodiment, elastic material is formed into a loop 300 by means of a securing attachment. The elastic material is dimensioned so that the loop 300 formed is under tension. In one possible implementation the elastic material is stretchy-cloth-covered elastic cord and one possible securing attachment is a square knot 400. Other possible permanent and non-permanent attaching methods are possible, including: bonding, gluing the ends together, plastic snaps, clasp, crimped metal, hook and loop attachment, strings, a pin, or any other suitable fastening method.

A feature of this embodiment is that the loop 300 is attached such that the material is stretched before it is fastened. Therefore, the elastic force keeps it in place as it is moved along the throat 114. This is an optional feature of the present invention, and is not necessary for the system to function.

In this embodiment, affixed to the racket 100 as discussed above, specifically to the throat 114, are eight colored, elastic loops 300. Each is affixed under light tension so that they can be positioned easily by the player, but remains in place during play.

Returning to the operation of this first possible embodiment, first loop 310, second loop 320, third loop 330 and fourth loop 390 are each affixed to encircle the left side of the throat 114*a*, representing the score of the player. First loop 310 is affixed closest to the head 112. Second loop 320 is affixed second closest to the head 112. Third loop 330 is affixed third closest to the head 112. Fourth loop 390 is affixed closest to the bottom of the throat 116.

Likewise in this embodiment first loop 350, second loop 360, third loop 370 and fourth loop 395, which are each affixed to encircle the right side of the throat 114*b*, represent the score of the opponent. First loop 350 is affixed closest to the head 112. Second loop 360 is affixed second closest to the head 112. Third loop 370 is affixed third closest to the head 112. Fourth loop 395 is affixed in the bottommost position closest to the bottom of the throat 116. In FIG. 1, the tennis game score shown is 'love all' or 0-0 since no loops 300 are noticeably in the upwards part of the throat 114. Therefore, in this embodiment, the score is kept with two positions: a lower position and an upper position. This embodiment is, in effect, a binary system of keeping score, rather than a system where one marker is moved to a multitude of different positions representing the many scores in tennis. When a first loop, such as 310, is moved from the first position to the second position, it may represent a score of 15 for the first player. When a second loop 360 is moved to the second position, it may represent a score of 30 for the second player, and so on. A more detailed discussion of one possible scoring method is given below. However, the movement of a particular loop 300 from one position to another represents a specific score, rather that the movement of one loop 300 to numerous different positions.

In a variation of this first possible embodiment, the system can be attached to any assembly with at least two elongated branches or shafts. With the score-keeping system affixed, such an assembly must be clearly distinguishable as to which direction is up and which direction is down. Such a device could be used by a spectator or scorekeeper, for example.

A possibly desirable variation on the embodiment may be to make the loops 300 distinguishable from each other through color. Thus contrasting colors distinguishing the loops 300 in the various embodiments will be referred to as color A, color B, color C, color D, color E, color F, color G and color H. However, any number of different colors may be desirable, including one for the player and one for the opponent.

For this embodiment, FIG. 1, three colors are used: color A for the first, second, and third loops 310, 320 and 330 on the left side of the throat 114*a* representing the player's first three points. Color B is used for loop 350, loop 360 and loop 370 on the right side of the throat 114*b*, representing the opponent's first three points. A third color, color C, is used for loop 390 and loop 395, the bottom loop of the left and right side. Loop 390 of Color C represents the player's "advantage" score and loop 395 of color C represents the opponent's "advantage" score. The color of the top three loops 310. 320, 330 on one side of the throat 114*a* contrasts with the color of the top three loops 350, 360, 370 on the other side 114*b* so that the player's score on throat 114*a* can easily be distinguished from the opponent's score on throat side 114*b*.

The current invention must have a plurality of loops 300 on the left distinguishable from a plurality of loops 300 on the right so that the score-keeper can easily distinguish the player's score from the opponent's score. Therefore, the color of the loops 300, or patterns or other markings on them can serve more than merely a decorative function. Although three solid colors distinguishing the player's score from the opponent's score as explained above is a preferred embodiment, other embodiments can be colored, patterned and marked in various ways.

Referring to FIG. 1, each of the 8 loops 300 are made of elastic, colored material. In the preferred embodiment, each piece of elastic, colored material is affixed to the throat 114 of the racket so that it forms a loop 300 under light tension. The tension of each loop 300 is set so that each loop 300 moves easily when the player slides and/or pulls it to position it, it but stays in place during play. In one possible embodiment, it may be desirable for the throat 114 to have shafts 114*a* and 114*b* of substantially uniform cross-sections. Their size and shape—and therefore, their perimeter length—may vary along their length. However, this change may be controlled to an amount that keeps the loops 300 in tension. For example, the perimeter of the left shaft 114*a* may change along the length of the shaft 114*a*. In this case, the change in perimeter could be less than the amount that the loops 300 have been stretched. Otherwise, the loops 300 may lose tension. This amount may be controlled to a specified amount, such as 25% change of the perimeter. However, other possible embodiments may not include this feature. For example, it may be possible to include a feature where the loops 300 are out of tension in one position and in tension in a second position, or another retention feature may be used. In yet another embodiment, it may be possible to make use of an abrupt change in perimeter as a detent to hold a loop 300 in a particular position.

For this preferred embodiment, there are two crimps 500, see Detail A, per loop 300. Each crimp 500 crimps each end of the cloth-covered elastic above the square knot 400 to defer fraying of the cloth. But the crimps 500 can be left off since they do not affect the efficacy of the square knot 400. Other suitable ends above the square knot 400 could also be used such as metal caps, a various numbers of crimps, plastic caps, or dipping the end in glue.

In one possible embodiment, the elastic cord used for the loops 300 each has a cross-sectional diameter of 4 mm. But larger and smaller cross-sectional diameters for the elastic material for the loops 300 are possible. For example, the loops 300 can be formed from an elastic material with a smaller cross-sectional diameter to make them more ergonomic for children or sized larger to make them more ergonomic for adults. Generally, the cross-sectional diameter is a large enough size so that it is comfortable enough to be grasped easily. It may be desirable that the cross-sectional diameter be small enough so that there remains a noticeable difference in the plurality of loops 300 in the upwards versus the downwards position.

Regarding the cross-sectional diameter of the loops 300, the cross-sectional diameter of all the loops 300 should be similar so that a plurality of loops 300 on the left of two elongated shafts 114*a* can be easily compared with a plurality of loops 300 opposing them on the right of two elongated shafts 114*b*. In the various embodiments discussed in the specification, the cross-sectional diameter of all the loops 300 is the same. However, they could also be different so that they can be easily distinguished.

For the various embodiments the crimps 500 each have a cross-sectional diameter of a corresponding size necessary to crimp the cross-sectional diameter of the elastic material used.

Also, whereas in these embodiments the cross-section of the elastic loops 300 is a round shape, other non-round shapes such as slightly oval or hexagonal are possible. Also, whereas in the embodiments the surface texture of the loops 300 is smooth, different surface textures could be utilized for the loops 300 to make the loops 300 more distinctive. For example, the player's loops: loop 310, loop 320, loop 330 and loop 390 could be bumpy and the opponent's loops: loop 350, loop 360, loop 370 and loop 395 could be smooth.

Turning to the method of using the embodiment disclosed in FIG. 1, the eight loops 300 are raised or lowered one at a time by the player to keep score during each game of tennis in a tennis match. If the player neglects to mark the score after the point he can catch up the score by moving more than one loop 300. The player marks his points on the left side of the throat 114*a*, in FIG. 1. Loop 310, loop 320 and loop 330, located on throat side 114*a*, have the distinctive color A. The distinctive color A lets the player easily identify the left side of the throat 114*a* representing his score. Loop 350, loop 360 and loop 370 may all have the distinctive color B and are located on the right side of the throat 114*b*. The distinctive color B lets the player easily identify the right side of the throat 114*b* representing the score of his opponent.

Referring to the method of keeping score, at the start of the game the player has all 8 elastic loops 300 noticeably positioned downwards towards the bottom of the throat 116 of the racket. Seeing no loops 300 up, the player will translate this into the tennis score of 0-0 or "Love All", as in FIG. 1.

After each point the player keeps score by noticeably raising or noticeably lowering one of the 8 loops 300 in the following combinations shown in Table 1. The traditional tennis score can then be easily translated in the player's head by referring to the number of loops 300 up. Any loop 300 described as "up" or "down" in Table 1 means distinguishably higher or lower on the throat 114 than the other loops 300 and does not describe an exact position. Therefore, two positions are used in a relatively simple and binary scoring system for the user. This translates the four traditional tennis scores (per shaft 114*a* or 114*b* or per player) into a quick and simple two-position scoring system for the user. Put another way, there are a number of loop 300 combinations between the two shafts 114*a* or 114*b* and the two players. This translates the 20 traditional tennis scores: 0-0, 15-0, 0-15, 0-30, 30-0, 0-40, 40-0, 15-15, 15-30, 30-15, 40-15, 15-40, 30-30, 40-30, 30-40, Deuce, Advantage Player, Advantage Opponent, Return to Deuce from Advantage Player and Return to Deuce from Advantage Opponent into a quick and simple two-position scoring system for the user. It may eliminate the need for any markings on the racquet 100 that need to be observed by the user. It also may enable a system that can be used with any existing racquet 100 rather than needing a specially designed racquet with markings and/or detents on it. Therefore, noticeably lower on the shaft 114*a* or 114*b* is the first position and noticeably higher on the shaft 114*a* or 114*b* is the second position, in one possible embodiment.

In the following Table 1, the first two columns of each line describe one possible combination of loops 300 in the up position the player could see when referring to a score already marked using the present invention. The third column is the common or typical tennis score to which the player will translate this. The fourth column details the single loop 300 that was raised or lowered to mark that score assuming that the player marks the score after every point. In Table 1 the player is serving.

Had the opponent been serving, then each of these game scoring combinations is the same but the score is flipped with the opponent's score called out first as is the rule in tennis.

TABLE 1

One Possible Score-Keeping Method: How to refer to the score and how to mark the score.

| Left side of throat 114a, loops up | Right side of throat 114b, loops up | Anachronistic tennis score | To mark score which single loop positioned/Slid up or down |
|---|---|---|---|
| None | none | Love All | none |
| 310 | none | 15-0 | 310/up |
| 310 and 320 | none | 30-0 | 320/up |
| 310, 320, 330 | none | 40-0 | 330/up |
| None | 350 | 0-15 | 350/up |
| None | 350 and 360 | 0-30 | 360/up |
| None | 350, 360 and 370 | 0-40 | 370/up |
| 310 | 350 | 15-15 | 310 or 350/up |
| 310 and 320 | 350 and 360 | 30-30 | 320 or 360/up |
| 310, 320 and 330 | 350, 360 and 370 | 40-40 or deuce | 330 or 370/up |
| 310 | 350 and 360 | 15-30 | 310 or 360/up |
| 310 | 350, 360 and 370 | 15-40 | 310 or 370/up |
| 310 and 320 | 350 | 30-15 | 320 or 350/up |
| 310, 320 and 330 | 350 | 40-15 | 330 or 350/up |
| 310 and 320 | 350, 360 and 370 | 30-40 | 320 or 370/up |
| 310, 320 and 330 | 350 and 360 | 40-30 | 330 or 360/up |
| 310, 320, 330 & 390 | 350, 360 and 370 | Ad-in | 390/up |
| 310, 320 and 330 | 350, 360, 370 & 395 | Ad-out | 395/up |
| 310, 320 and 330 | 350, 360 and 370 | Return to deuce from Ad-in | 390/down |
| 310, 320 and 330 | 350, 360 and 370 | Return to deuce from Ad-out | 395/down |

To reset the system at the end of the game, all loops 300 are pushed down to the first position.

For the purposes of this disclosure, a "loop" 300 can be a single circle of flexible material, but it can be semi-rigid and open on one end, such as a rubber slider in a C-shape. It can also be a variety of shapes and cross-sections. For example, a slider that is open on one end but hooks around a cross section, but is open at one end, rectangular cross-section, with a tennis racquet 100 on one surface, would still be considered a "loop" 300 within the definition of this disclosure. It substantially surrounds and/or attaches to a shaft 114*a* or 114*b*. An infinite number of different functional and cosmetic combinations are possible that are still within the functional scope of the present invention.

Also, in terms of loop 300 "positions," the positions can be clearly delineated or more general. For example, an up or down position can be marked. However, it can also be an unmarked general position, such as near the top of a shaft 114*a* or 114*b*, or a visibly different position from the bottom of a shaft 114*a* or 114*b*, and still fall within the scope of this disclosure. The only minimum requirement would likely be that the positions are visibly different from each other, so that a user could determine whether a loop 300 is up or down, for example, at a glance. Thus, marking is not necessarily required to accomplish that. As a non-limiting example, if the "up" position is 30 millimeters from the "down" position, a user would be able to tell if a loop 300 is "up" or "down." On the other hand, the positions do not have to be exact. If a loop 300 is positioned somewhere near the top of a shaft 114*a* or 114*b*, versus somewhere near the bottom of the shaft 114*a* or 114*b*, the loops 300 would probably be in two visibly different positions.

In another embodiment, a specific position for each loop 300 could be marked on the racquet 100. For example, there could be a line or other marking for the top loop 310, another line near it for the second loop 320, another marking just below for the third loop 330, and another mark below that for the fourth advantage loop 390. Therefore, a "position", such as the "up" position may actually be made up of a number of different positions. The "up" position may mean a general position comprising four different marked areas in the case of this embodiment, and still fall within the scope of the invention. In fact, even without markings, the loops 300 will be separated from each other by at least the width of each loop 300. Therefore, each position will be a general area with a length of at least the width of the total number of loops 300 on each shaft in a position. The defining factor may then be whether there is a general position when a user can determine which position the loop 300 has been moved to.

Figure 2:
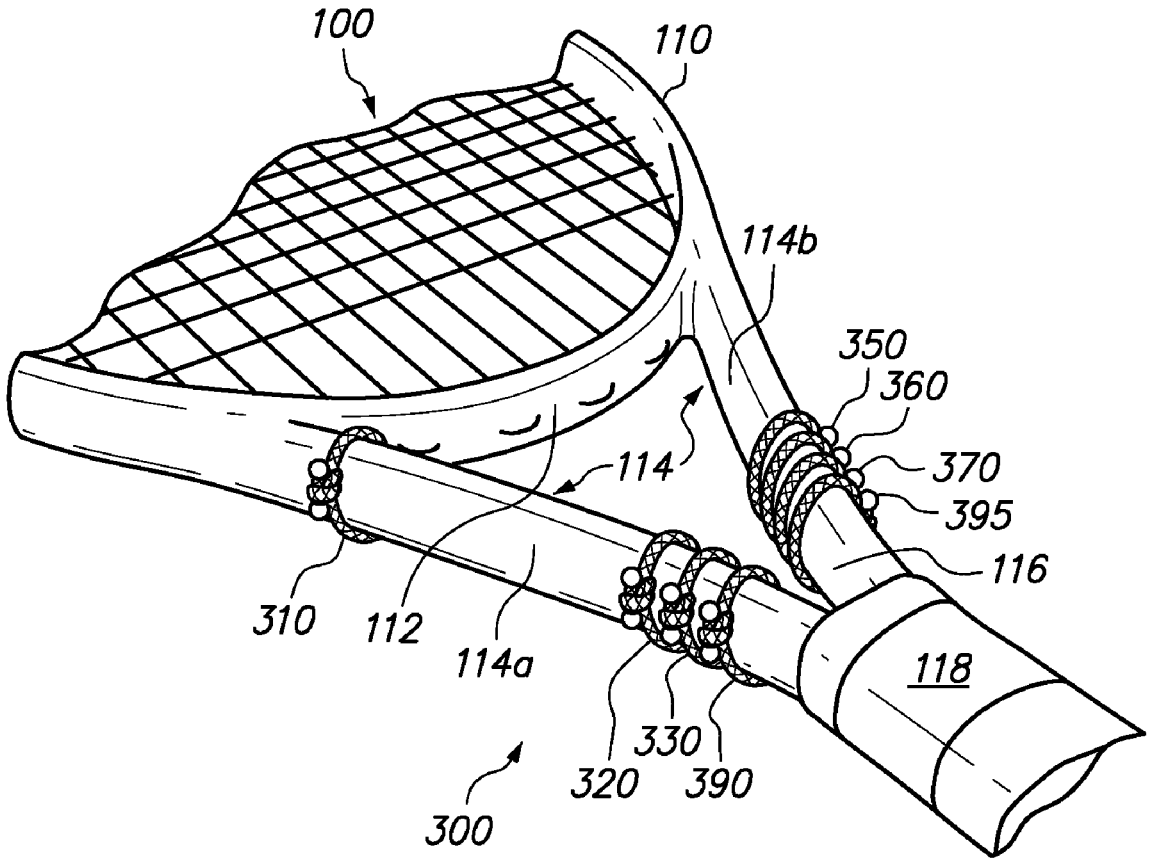
FIG. 2 shows one possible score of 15-0, player serving, in the first embodiment.

Turning to FIG. 2, this figure shows an embodiment of the score-keeping system, attached to the throat 114 of a tennis racket 100, showing the score of 15-0, with the player serving. Regarding the two-position binary system of the invention with position one being noticeably down on the shaft 114 and position two being noticeably up, loop 310 is in position two on shaft 114*a* and the rest of the loops 300 are in position 1.

Figure 3:
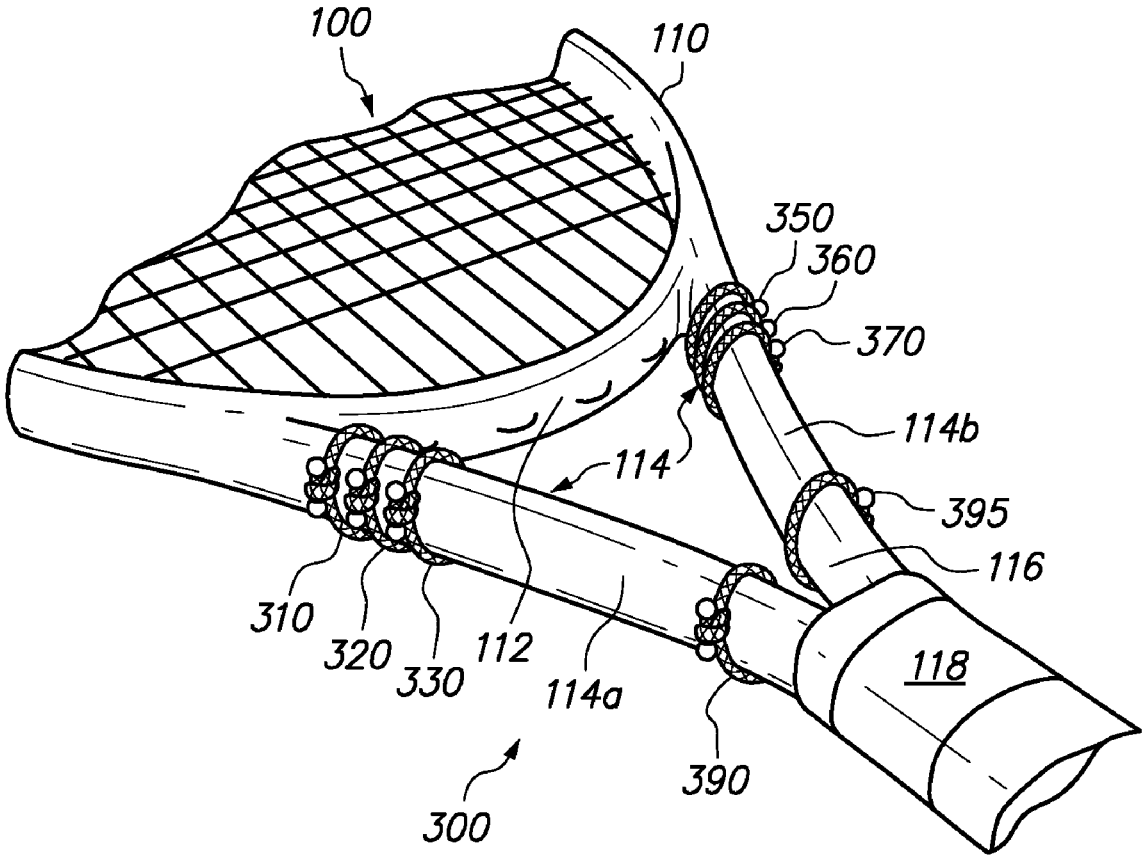
FIG. 3 shows one possible score of deuce, in the first embodiment.

Turning to FIG. 3, this figure shows an embodiment of the scoring system attached to the throat 114 of a tennis racket 100, showing the score of deuce. Regarding the two-position binary system of the invention with the first position being noticeably down on the shafts 114 and the second position being noticeably up, loops 310, 320 and 330 are in the second position on left shaft 114*a* and likewise loops 350, 360 and 370 are in the second position on right shaft 114*b*. Loop 390 is in the first position on left shaft 114*a* and likewise loop 395 is in the first position on right shaft 114*b*.

Figure 4:
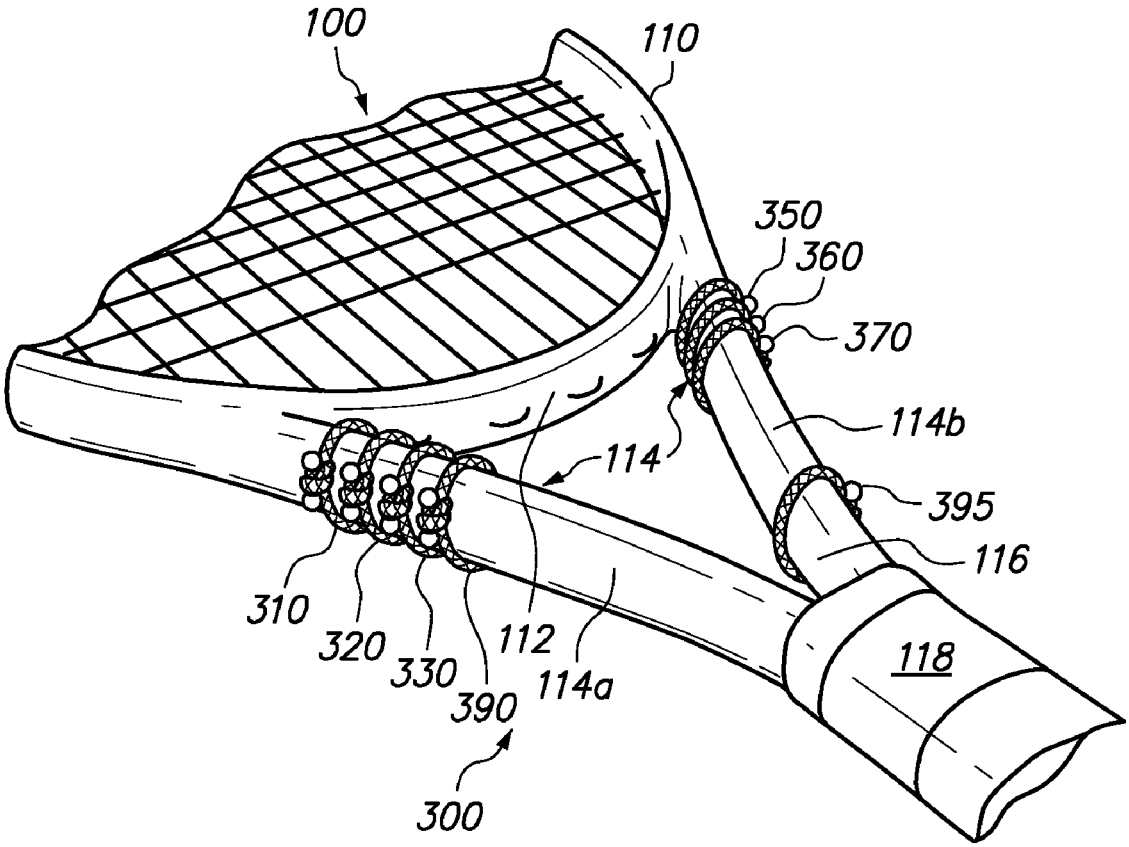
FIG. 4 shows one possible score of Ad-in, player serving, in the first embodiment.

Turning to FIG. 4, this figure shows an embodiment of the scoring system, attached to the throat 114 of a tennis racket 100, showing the score of Ad-in, player serving. Regarding the two-position binary system of the invention with the first position being noticeably down on the shaft 114 and the second position being noticeably up, loops 310, 320, 330 and 390 are in the second position on left shaft 114*a* and loops 350, 360 and 370 are in the second position on right shaft 114*b*. Loop 395 is in the first position on right shaft 114*b*.

Turning to another embodiment, it is also possible to keep score using the embodiments during a tie break. A tie break occurs near the end of a set when the score of "6 games all" has been achieved. Occasionally, a tie break is used in training or to decide a match when the score of the sets are tied and no further sets are desired.

Using one possible method, one starts with all the loops 300 in the first position, down towards the bottom of the throat 116. The first point of the Player is shown by moving first loop 310 halfway to the top, that is, to a third position noticeably halfway between the first position and the second position. The second point of the Player is shown by moving first loop 310 to the second position, all the way to the top. The Player's and Opponent's points are kept similarly until at "6 all" three loops 310, 320 and 330 are in the up position on the left shaft 114*a* and 3 loops 350, 360 and 370 are in the up position on the right side of the right shaft 114*b*. In this way, if the seventh point is reached before "six all" is reached, the tie break is over. After "six all" has been reached, the bottom loop, loop 390 on the left shaft 114*a* and loop 395 on the right shaft 114*b* represent the "advantage" of the respective player, since two points in a row must be won to win the tie-break. So, for example, after "six all" is reached and the Player wins the next point, loop 390 is raised to the second position, all the way to the top, to show this score of 7-6. If the Player loses the next point, loop 390 is lowered to the first position and although the loops 300 show that the score is tied again, the score-keeper must remember the exact score of 7-7. But since the crucial issue is to know who has the advantage, the invention is helpful.

Table 2 shows a number of possible examples marking and reading the score using this tie-break score-keeping method. This method is called the "Advantage Method". Not every possible tie-break combination of score is given, but enough examples are given so that one skilled in the art understands the method for keeping score using the embodiments in a tie break.

Note that, in this embodiment, three positions for the loops 300 are used: a lower position, a mid-way position, and an upper position. It may be possible to use the tie-break system with two positions, or to use the scorekeeping system with three or more positions.

TABLE 2

One Possible Method for Keeping Score During a Tie-Break, the "Advantage Method."

| Left side of throat 114a, loops up halfway | Left side of throat 114a, loop or loops up near the head 112 | Right side of throat 114b, loop or loops halfway up | Right side of throat 114b, loop or loops up near the head 112 | Tie-break score | To mark score which single loop positioned?/Slid halfway up/slid up to head 112 |
|---|---|---|---|---|---|
| 1 | 0 | 0 | 0 | 1-0 | 310 halfway |
| 1 | 0 | 1 | 0 | 1-1 | 350 halfway |
| 0 | 1 | 1 | 0 | 2-1 | 310 up to head 112 |
| 0 | 1 | 0 | 1 | 2-2 | 350 up to head 112 |
| 1 | 1 | 0 | 1 | 3-2 | 320 halfway |
| 1 | 1 | 1 | 1 | 3-3 | 360 halfway |
| 0 | 2 | 1 | 1 | 4-3 | 320 up to head 112 |
| 0 | 2 | 0 | 2 | 4-4 | 360 up to head 112 |
| 1 | 2 | 0 | 2 | 5-4 | 330 halfway |
| 1 | 2 | 1 | 2 | 5-5 | 370 halfway |
| 0 | 3 | 1 | 2 | 6-5 | 330 up to head 112 |
| 0 | 3 | 0 | 3 | 6-6 | 370 up to head 112 |
| 0 | 4 | 0 | 3 | 7-6 | 390 up to head 112 |
| 0 | 3 | 0 | 3 | 7-7 | 390 down all the way to shaft 116 |
| 0 | 4 | 0 | 3 | 8-7 | 390 up to head 112 |
| 0 | 3 | 0 | 3 | 8-8 | 390 down all the way to shaft 116 |
| 0 | 3 | 0 | 4 | 8-9 | 390 up to head 112 |

Second method for keeping score using the embodiments in a tie-break, the "Binary Position Method". Here, for each point in the tie-break, one appropriate loop 300 is moved the whole distance towards the head 112, so a point is marked by moving the appropriate loop 300 from the first position to the second position. Using this method the score-keeper starts with all the loops 300 down towards the bottom of the throat 116. The first point of the Player is shown by moving the top loop 310 to the second position. In this method, for example, loops 310 and 350 in the up position, both in the second position, would mean "1 all". When the opponent or player reaches 4 points, his loops 300 must be returned back down to the first position in order to continue keeping score. Attaining 4 points may be a common occurrence in tie breaks, so using this method has one possible advantage of interpreting clearly the first four points but the disadvantage of needing to remember that four points had been achieved to continue to the $5^{th}$ point.

In a third possible method of keeping score during a tie-break, the "8-All method", each loop 300 is first raised half-way, to the third position, and then the full way, to the second position, until either one player has won or the score of "8-all" has been attained. After 8-all has been reached, all the loops 300 are lowered so that the score-keeping can continue. The score-keeper will have to remember that "8-all" had been attained. This is an extraordinary occurrence in tennis and would be difficult to forget. That is, it is not likely that the scorekeeper would think the tie-break had just begun. Table 3 shows a number of possible examples using the "8-All Method". This method is more appropriate for the score-keeper who wishes to know the exact numerical score. Not every possible tie-break combination of score is given, but enough examples are given so that one skilled in the art understands the method for keeping score using the embodiment in a tie-break.

Note that, as in the "Advantage Method", in this embodiment, three positions for the loops 300 are used: a lower position, a mid-way position and an upper position. In lieu of marking the point, when 8-All is reached, in yet another embodiment, the scorekeeper can simply move all loops 300 back down. (The player will have to remember that "8 all" had been attained). This is an extraordinary occurrence in tennis and would be difficult to forget. That is, it is not likely that the scorekeeper would think the tie-break had just begun.

Using another possible method, shown in Table 3, one starts with all the loops 300 down toward the bottom of the throat 116. The first point of the player is shown by moving the top loop 310 halfway to the top. The second point of the player is shown by moving the top loop 310 all the way to the top of throat side 114*a*. The opponent's points are kept similarly until, at "8 all", all eight loops 300 are up. After "8 all" is marked all the loops 300 are returned back down.

TABLE 3

Another Possible Method for Keeping Score During a Tie-Break, the "8-All Method"

| Left side of throat 114a, loops up halfway | Left side of throat 114a, loop or loops up near the head 112 | Right side of throat 114b, loop or loops halfway up | Right side of throat 114b, loop or loops up near the head 112 | Tie-break score | To mark score which single loop positioned?/Slid halfway up/slid up to head 112 |
|---|---|---|---|---|---|
| 1 | 0 | 0 | 0 | 1-0 | 310 halfway |
| 1 | 0 | 1 | 0 | 1-1 | 350 halfway |
| 0 | 1 | 1 | 0 | 2-1 | 310 up to head 112 |
| 0 | 1 | 0 | 1 | 2-2 | 350 up to head 112 |
| 1 | 1 | 0 | 1 | 3-2 | 320 halfway |
| 1 | 1 | 1 | 1 | 3-3 | 360 halfway |
| 0 | 2 | 1 | 1 | 4-3 | 320 up to head 112 |
| 0 | 2 | 0 | 2 | 4-4 | 360 up to head 112 |
| 1 | 2 | 0 | 2 | 5-4 | 330 halfway |
| 1 | 2 | 1 | 2 | 5-5 | 370 halfway |
| 0 | 3 | 1 | 2 | 6-5 | 330 up to head 112 |
| 0 | 3 | 0 | 3 | 6-6 | 370 up to head 112 |
| 1 | 3 | 0 | 3 | 7-6 | 390 halfway |
| 1 | 3 | 1 | 3 | 7-7 | 395 halfway |
| 0 | 4 | 1 | 3 | 8-7 | 390 up to head 112 |
| 0 | 4 | 0 | 4 | 8-8 | 395 up to head 112 and then/or all loops are pushed back down |
| 1 | 0 | 0 | 0 | 9-8 | 310 halfway |

The scorekeeper would continue keeping score similarly. In the unlikely event that the score of "16-16" is attained, then all loops 300 are again pushed downwards and the scorekeeper would have to remember that 16-16 had been attained.

Figure 5:
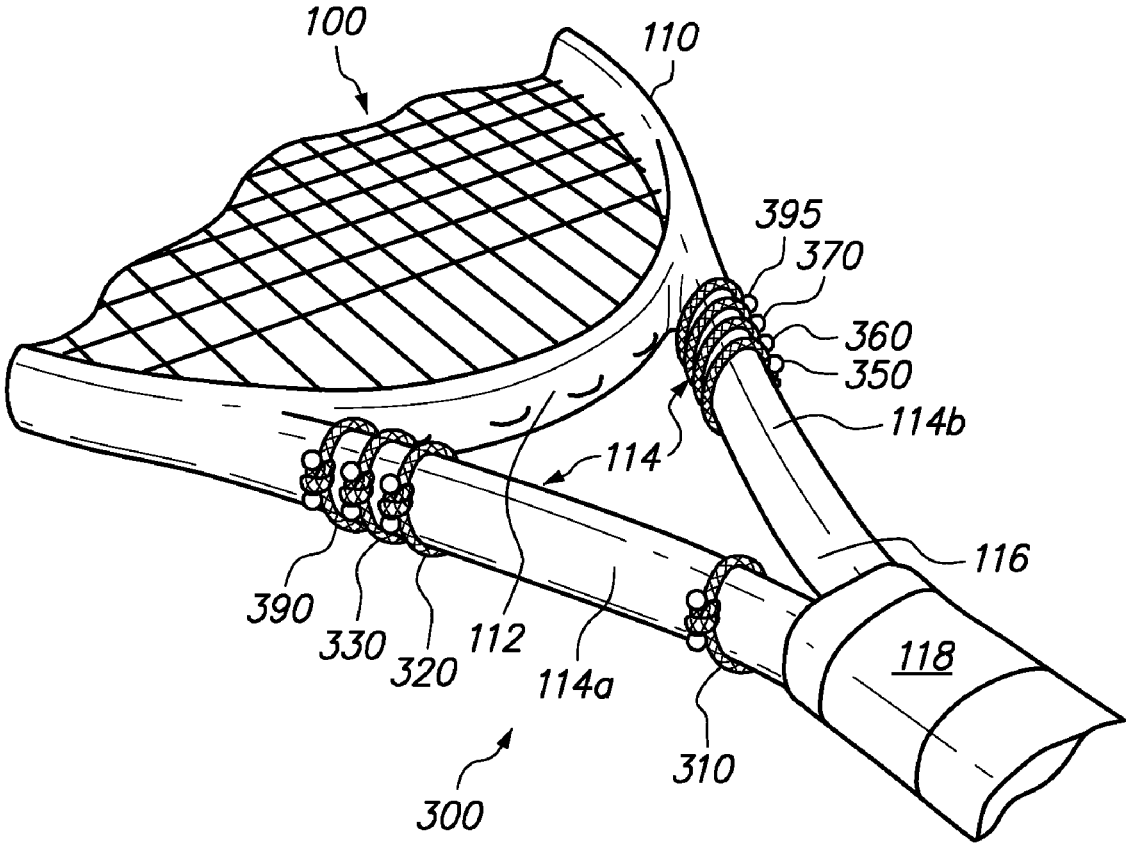
FIG. 5 shows a diagram of a second possible embodiment of the invention, with one possible score of 15-0.

Turning to FIG. 5, this figure shows a second possible embodiment of the system. In the second embodiment, the directions for affixing the loops 300 and for marking, referring to and resetting the score have been flipped as shown in FIG. 5. That is, on the left throat side 114*a*, loop 310 is affixed closest to the bottom of throat 116. Loop 320 is affixed second closest to the bottom of the throat 116. Loop 330 is affixed third closest to the bottom of the throat 116. Loop 390 is affixed above the other three loops 310, 320, 330, closest to the head 112. The colors of the loops 300 are the same as in the preferred embodiment.

On throat side 114*b* loop 350 is affixed closest to the bottom of the throat 116. Loop 360 is affixed second closest to the bottom of the throat 116. Loop 370 is affixed third closest to the bottom of the throat 116. Loop 395 is affixed above the other three loops 350, 360, 370, closest to the head 112. Therefore, regarding the binary system, position one is upwards and position two is downwards. For example, a score of "0-0" has all the loops 300 placed in the upwards position.

Therefore the score of 0-0 or 'love-all' may be shown when all loops 300 are up, towards the head 112. The score may be kept exactly the same way as detailed in embodiment 1, except the directions are the opposite.

FIG. 5 shows the score of 0-15 in the second embodiment, player serving. To reset the score at the end of a game using the second embodiment, all loops 300 are pushed upwards, towards the head 112.

In a third possible embodiment, four colors are used to make the loops 300 distinguishable: color A, color B, color C and color D for the loops 300 instead of three colors only. This embodiment utilizes color D for "advantage" of the opponent loop 395, instead of color C.

In a fourth possible embodiment, eight colors may be used to make the eight loops 300 distinguishable instead of three. In this embodiment each loop 300 has a different distinguishing, solid color. Loop 310 is color A, loop 320 is color B, loop 330 is color C. Loop 390 is color D. Loop 350 is color E. Loop 360 is color F. Loop 370 is color G. Loop 395 is color H. This color system may be more meaningful to the scorekeeper if the top three loops 310, 320, 330 on shaft 114*a* and 350, 360, and 370 on shaft 114*b* are different shades of the same color going from lighter to darker. For example loop 310 could be light pink, loop 320 could be medium pink and loop 330 could be dark pink.

In yet another embodiment, the loops 300 can also made distinctive by being marked with the anachronistic tennis scoring numbers and/or words. Loop 310 is marked '15', loop 320 is marked '30' loop 330 is marked '40', loop 390 is marked 'Adv.', loop 350 is marked '15', loop 360 is marked '30', loop 370 is marked '40'. Loop 395 is marked 'Adv.'

Figure 6:
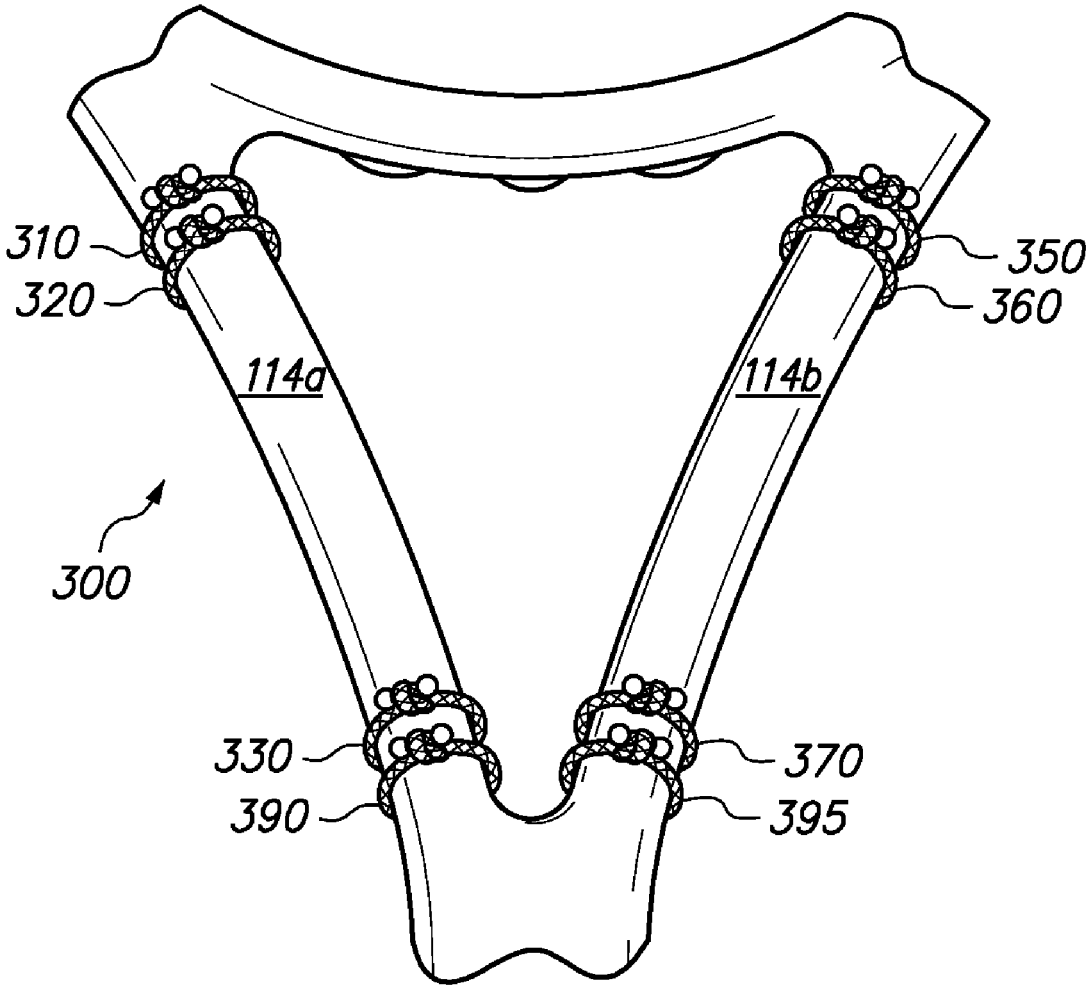
FIG. 6 shows a diagram of a sixth possible embodiment of the invention, with a triangular assembly housing eight elastic loops, with one possible score of 0-0.

Turning to FIG. 6, another embodiment is shown wherein the tennis-game score-keeping system of eight loops 300 is attached to a non-tennis racket assembly with at least two elongated shafts, here a triangular assembly. This embodiment may be used for spectators and could be used in many ways. For example, it could be attached to the front of a notebook by means of three supporting members. This embodiment could also hang from a bag or purse with a short chain connecting the system to a clip. Since in this embodiment the three solid colors of the preferred embodiment are used to distinguish the loops 300, then the scorekeeper knows "up" is the direction furthest away from the Color C used for the two bottommost loops: loop 390 and loop 395. In yet another embodiment, extra material, for example a bead or other grip, can be affixed to each loop 300 to make each one easier to grab and manipulate.

From the description above, a number of possible advantages of some embodiments of the score-keeping system becomes evident, and vary, depending on the features incorporated into the specific embodiment:

(a) The system may be easier to manipulate than other scoring systems. Moving a loop 300 upwards, to no particular point, is simpler than moving a marking device onto a particular number. Using fewer fine motor skills means the embodiments are more likely to be used by an athlete.

(b) Once marked, the score may be easier to read than prior art for two reasons: first, the score, the plurality of loops 300 in the up position, may be gleaned from almost any angle the tennis racket 100 is held. For other assemblies, such as the embodiment in FIG. 7, this can also hold true. Second, the player or spectator does not have to read cumbersome tennis numbers but instead sees colorful loops 300, notes how many are up and can translate that into a tennis score in her head.

(c) After the game is won, resetting may be easier than other scoring systems. Resetting, pushing all loops 300 downwards, can be done without looking. This cannot be said of scoring systems which involve moving a marker to a particular number, '0', or word, 'love'.

(d) The embodiments may be more economical and dependable than other scoring systems in that they are simple to produce while at the same time they hold up well, even when players fall hard or throw their rackets 100.

(e) The embodiments may be simpler because they are not glued to the racket 100 or to the elongated branches of an assembly, and there are no batteries or interacting parts.

(f) Each embodiment utilizes a new paradigm over tennis scoring systems, one that allows the player or spectator to mark that a point has been made, not locate a particular number score. This new paradigm understands that players think in points and then translate the points into the tennis score. This system may be inherently easier for players to use since, in actual play, when players are arguing about the correct score, they do not refer to, say, "point 15", but rather, "the first point."

While the invention contains many specificities, these should not be construed as limitations on the scope of the invention, but rather as an exemplification of one preferred embodiment thereof.

The foregoing description and drawings comprise illustrative embodiments of the present invention. Having thus described exemplary embodiments of the present invention it should be noted by those skilled in the art that the within disclosures are exemplary only, and that various other alternatives, adaptations and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing description and the associated drawings. Although specific terms may be employed herein, they are used in a generic and descriptive sense only and not for purposes of limitation. Accordingly, the present invention is not limited to the specific embodiments illustrated herein, but is limited only by the following claims.

It is, therefore, apparent that there is provided in accordance with the present invention, systems and methods for sports game scoring. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A tennis scoring system, comprising:

a first shaft, exactly four loops attached to the first shaft, a first position on the first shaft for the loops to be positioned, a second position on the first shaft for the loops to be positioned, a second shaft, exactly four loops attached to the second shaft, a first position on the second shaft for the loops to be positioned, and a second position on the second shaft for the loops to be positioned, wherein a first color is used for three of the loops attached to the first shaft, a second color is used for three of the loops attached to the second shaft, and a third color is used for one of the loops attached to the first shaft and for one of the loops attached to the second shaft.

2. The tennis scoring system of claim 1, wherein the four loops attached to the first shaft are moved among three positions on the first shaft and the four loops attached to the second shaft are moved among three positions on the second shaft to determine the winner of a tie break in tennis.

3. The tennis scoring system of claim 1, wherein the loops are made of an elastic material.

4. The tennis scoring system of claim 1, wherein the loops are labeled with score information.

5. A tennis scoring system, comprising:

a first shaft that is substantially uniform in cross-section along its length, exactly four loops attached to the first shaft, exactly two visibly different positions on the first shaft that the four loops can be moved among, a second shaft that is substantially uniform in cross-section along its length, exactly four loops attached to the second shaft, exactly two visibly different positions on the second shaft that the four loops can be moved among.

6. The tennis scoring system of claim 5, further comprising:

a first loop that is attached to a first shaft that is moved from the first position to the second position to represent a score of 15, a second loop that is attached to a first shaft that is moved from the first position to the second position to represent a score of 30, a third loop that is attached to a first shaft that is moved from the first position to the second position to represent a score of 40, a fourth loop that is attached to a first shaft that is moved from the first position to the second position to represent an advantage.

a first loop that is attached to a second shaft that is moved from the first position to the second position to represent a score of 15, a second loop that is attached to a second shaft that is moved from the first position to the second position to represent a score of 30, a third loop that is attached to a second shaft that is moved from the first position to the second position to represent a score of 40, and a fourth loop that is attached to a second shaft that is moved from the first position to the second position to represent an advantage.

7. The tennis scoring system of claim 6, further comprising:

a position on at least one of the shafts, wherein at least one of the loops can be moved to said position indicate a score of Deuce.

8. The tennis scoring system of claim 5, wherein the first shaft and the second shaft are the two branches at the throat of a tennis racquet.

9. The tennis scoring system of claim 5 wherein the loops are labeled with score information.

10. A tennis scoring system, comprising:

a first shaft that is substantially uniform in cross-section along its length, exactly four loops attached to the first shaft, exactly three visibly different positions on the first shaft that the four loops can be moved among, a second shaft that is substantially uniform in cross-section along its length, exactly four loops attached to the second shaft, exactly three visibly different positions on the second shaft that the four loops can be moved among.

11. The tennis scoring system of claim 10, wherein the four loops attached to the first shaft are moved among the three positions on the first shaft and the four loops attached to the second shaft are moved among the three positions on the second shaft to determine the winner of a tie break in a tennis game.

12. The tennis scoring system of claim 11, further comprising:

a first color used for three of the loops attached to the first shaft, a second color used for three of the loops attached to the second shaft, and a third color used for one of the loops attached to the first shaft and for one of the loops attached to the second shaft.

* * * * *